US010837165B2

(12) United States Patent
Brant

(10) Patent No.: US 10,837,165 B2
(45) Date of Patent: Nov. 17, 2020

(54) SYSTEM TO PREVENT BASEMENT FLOODING FROM SEWER BACKUP

(71) Applicant: Ronald A. Brant, Windsor (CA)

(72) Inventor: Ronald A. Brant, Windsor (CA)

( * ) Notice: Subject to any disclaimer, the term of this patent is extended or adjusted under 35 U.S.C. 154(b) by 77 days.

(21) Appl. No.: 16/218,896

(22) Filed: Dec. 13, 2018

(65) Prior Publication Data

US 2019/0177963 A1 Jun. 13, 2019

(30) Foreign Application Priority Data

Dec. 13, 2017 (CA) ..... 2988730
Dec. 12, 2018 (CA) ..... 3027294

(51) Int. Cl.

| | |
|---|---|
| ***E03F 5/22*** | (2006.01) |
| ***E03F 7/04*** | (2006.01) |
| ***E03F 5/042*** | (2006.01) |
| ***E03F 5/04*** | (2006.01) |
| ***E03F 3/02*** | (2006.01) |
| ***E03F 7/00*** | (2006.01) |

(52) U.S. Cl.

CPC ..... *E03F 5/22* (2013.01); *E03F 3/02* (2013.01); *E03F 5/042* (2013.01); *E03F 5/0407* (2013.01); *E03F 7/00* (2013.01); *E03F 7/04* (2013.01)

(58) Field of Classification Search

CPC . E03F 3/02; E03F 5/0407; E03F 5/042; E03F 5/22; E03F 7/00; E03F 7/02

See application file for complete search history.

(56) References Cited

U.S. PATENT DOCUMENTS

| | | | | |
|---|---|---|---|---|
| 3,605,799 | A | 9/1971 | Cherne | |
| 5,967,759 | A | 10/1999 | Jurado | |
| 6,406,620 | B1 * | 6/2002 | Rogers | B01D 29/03 210/155 |
| 7,857,968 | B2 * | 12/2010 | Connelly | B01D 21/0039 210/170.08 |
| 9,222,720 | B1 * | 12/2015 | Alba | F24F 13/222 |
| 2003/0131887 | A1 * | 7/2003 | Gaynier | E03C 1/122 137/357 |
| 2010/0065131 | A1 * | 3/2010 | Grooms | E03F 1/007 137/205 |

* cited by examiner

*Primary Examiner* — Kevin F Murphy
(74) *Attorney, Agent, or Firm* — Sheridan Ross P.C.

(57) ABSTRACT

The invention relates to a building basement flood control system that eliminates termination of sanitary and storm sewer lines within a building. The control system includes a sanitary sewage basin system and a storm water sump pit installed in the basement floor. A sewage pump in the sewage basin pumps sewage through a discharge pipe extending to the exterior of the basement wall for discharge into an open end of an above ground vertical sanitary sewer line adjacent an exterior basement wall. The control system further includes a storm water sump pit installed in the basement floor. A sump pump in the sump pit pumps storm water through a discharge pipe extending to the exterior of the basement wall for discharge into an open end of an above ground vertical storm sewer line adjacent the exterior basement wall.

27 Claims, 9 Drawing Sheets

14P
11
14S
12
75
160
155
130
125
130

SYSTEM TO PREVENT BASEMENT FLOODING FROM SEWER BACKUP

CROSS REFERENCE TO RELATED APPLICATION

This application claims the benefit of Canadian Patent Application No. 2,988,730 filed Dec. 13, 2017 and Canadian Patent Application No. 3,027,294 entitled System to Prevent Basement Flooding from Sewer Backup filed on Dec. 12, 2018, and which are incorporated herein by reference as if fully set forth herein.

TECHNICAL FIELD

The invention relates to a flood prevention system for controlling building basement flooding from sanitary sewers, storm sewers and weeping tile connections of a building.

BACKGROUND

Residential buildings typically have drain pipes from showers, bathtubs, sinks, toilets and appliances that connect into a main drain pipe that in turn connects to a municipal sewer pipe. The basement of a residential building also has a floor drain connected to the municipal sewer pipe.

A residential building typically has buried weeping tiles/pipe around the perimeter of the basement foundation walls connected to a building storm sewer line which in turn connects to a municipal sewer pipe or in some jurisdictions, a separate municipal storm sewer. The weeping tiles collect and channel away water from the building foundation. Building downspouts may also be connected into the building storm sewer line.

The building drain pipe connections to the one or more municipal sewage lines terminate within the residential building, and in particular at the basement floor.

A municipal sewage system comprises a complex infrastructure of underground pipes, sewers and catch-basins. Municipal sewage systems may provide for separate underground sanitary and storm sewer mains that are separately connected to sanitary and sewage discharges lines from a building. In older parts of some municipalities the underground sanitary and sewage systems lines from a building discharge into a single combined sanitary and sewer main.

In older residential areas, many existing municipal sewers are not adequately sized to accommodate recent developments in their service area, or, they become unable to properly discharge sewage because of aging infrastructure. Increasingly, more frequent severe weather events put additional strain on municipal sewer systems, often overwhelming municipal sewers resulting in repeated basement flooding of buildings.

In an effort to divert discharges to municipal storm sewers, many municipalities require homeowners to disconnect building downspouts from sewer connections and divert their discharge onto the ground away from the exterior walls of the building.

Sewage backups occur when sudden and severe rainfall downpours or excessive spring runoffs overwhelm municipal sewage lines [particularly combined storm and sanitary sewers], causing sewage effluent to reverse its flow from the main municipal sewer lines back into the building basement often via the basement floor drain, but also through basement toilets and sinks.

Sewage backup remedial actions have included installing sump pumps which discharge accumulated water from ground water to the outside of the building and by installing sewer backflow prevention devices such as backwater sanitary valves (also known as "check valves" or "backwater valves"). Backwater valves are mechanical devices that are designed to allow the flow of water in one direction only—away from the building into the municipal sewer line. Problems can arise from these valves because of improper installation or because of lack of maintenance. Either problem can result in failure of the device resulting in sewer backup through the valve into the building or sewer discharge into the house from toilets, showers etc., because a closed backwater valve prevents proper sewer discharge from the house.

Prior attempts to solve basement sewage backup problems have included installing a backup/backflow valve, a standard sump pump or battery backup sump pump have failed by varying degrees. These attempted solutions often fail because the building connections to the sewage lines remain terminated within or under the building which means that when backup flow equipment fails, sewage backups into the building.

FIG. 1 is representative of one fairly typical attempt to reduce the risk of sewage backup into the basement of a residential building. FIG. 1 is a cross section depiction of a residential building 1 having an above ground level 5 and a basement level 10. Drain pipes from a sink 11, bathtub 12, toilet 13 and laundry machine 14 connect to a 4 inch main building drain 15. The upper section of the building drain vents to atmosphere through the building roof 25. Venting prevents the creation of a vacuum from draining effluent. The building drain 15 connects into a sanitary sewer pipe/line 75 located underneath the basement floor 40. The basement floor is provided with a floor drain 28 and cleanout drain 29 that also connect into sanitary sewer line 75. The sanitary sewer line 75 is provided with a backup/backflow valve 31 to prevent backups through the floor drain 28 and other basement drains. In above grade homes as depicted, sewage systems operate based on gravity, wherein sewage flows downhill through the sanitary sewer line and enters a municipal sanitary sewer main typically located underneath a roadway.

Effluent from downspouts 104, 185 and weeping tiles 105 adjacent the building foundation are connected to the storm water sewage line 115 which may be located underneath the basement floor 40. A section of the storm sewage line discharges into a sump pit 125 below the basement floor. A submersible sump pump 130 is installed in sump pit 125. During higher water effluent flows, the level in the pit may rise. When the level in the sump pit reaches a pre-determined level, about 5 to 7 inches, a vertical float [not shown] activates the pump. The sump pump 130 is provided with a vertical discharge pipe 140 running above the sump pit and then horizontally through the basement wall 70 into a downspout drain pipe 142 below ground level. The downspout drain pipe 142 in turn connects to a section of the storm sewer line 115 which connects to the storm sewer main 145.

As depicted in FIG. 1, a sanitary sewer main 120 and a storm sewer main 145 are typically located underneath a roadway. Roadway catch basins 146 also drain into the storm sewer main.

U.S. Pat. No. 5,967,759 describes an apparatus for controlling sewage backup through the basement drain. The apparatus comprises a main pump unit which includes a main pump and a standby pump in a tank is placed on the basement floor, not in a sump basin. The tank is sealed with the floor level basement drain, preventing reverse sewer water from flowing onto the floor. The pump (main) turns on before the sewer water from overflowing the appliances, such as toilet and bathtub. The system includes an arrangement for using the customary fresh water supply for testing the pump. It also includes means for ventilating the tank to the exterior.

An object of the invention is to provide an integrated system that eliminates sanitary and storm sewer connections from any and all municipal sewer connections or gutter downspouts or pool flushing systems etc., from terminating in a building. Waste water and sewage from the building is collected and discharged to outside above ground sewage pipes.

SUMMARY OF THE INVENTION

The present invention is directed to basement flood control system for a building having an above ground level, a basement level and serviced by sewer lines connected to municipal sewer mains and is characterized by disconnection or removal of sewer piping [sanitary and storm] from inside the building to above ground termination ends outside the building.

In accordance with a first aspect of the invention, a building sanitary waste drain receiving effluent from fixture drains in the building connects to an inlet of a sewage basin installed into the basement floor. The sewage basin has side walls and a top lid. A sewage pump is installed in the sewage basin, the sewage pump having an outlet connected to a vertical sewage discharge pipe rising through the sewage basin lid. The discharge pipe extends to and through a basement wall for exterior discharge above ground level. A float activator arm with a buoyant ball positioned in the sewage basin is arranged to automatically activate and deactivate the sewage pump. A sump pit is installed into the basement floor at a second location, the sump pit having side walls and a top wall or lid. A sump pump is installed in the sump pit which has an outlet connected to a vertical sump discharge pipe rising through the sump basin lid. The discharge pipe extends to and through a basement wall for exterior discharge above ground level. A float activator arm with a buoyant ball is positioned in the sump pit and arranged to automatically activate and deactivate the sump pump. An underground sanitary sewer line connected at one end to a sanitary sewer main is installed to run substantially vertically adjacent an exterior basement wall to an open end above ground level. The sanitary sewer line open end terminates opposite the discharge end of the sewage discharge pipe. An underground storm sewer line connected at one end to a storm sewer main is installed to run substantially vertically adjacent an exterior basement wall to an open end above ground level. The storm sewer line open end terminates opposite the discharge end of the storm discharge pipe.

In accordance with another aspect of the invention, a building sanitary waste drain receiving effluent from fixture drains in the building connects to an inlet of a sewage basin installed into the basement floor at a first location. The sewage basin has side walls and a top lid. A sewage pump is installed in the sewage basin. The sewage pump has an outlet connected to a vertical sewage discharge pipe rising through the sewage basin lid. The sewage discharge pipe extends to and through a basement wall for exterior discharge above ground level. A float activator arm with a buoyant ball is positioned in the sewage basin and arranged to automatically activate and deactivate the sewage pump. A sump pit is installed into the basement floor at a second location. The sump pit has side walls and a top wall. A sump pump is installed in the sump pit which has an outlet connected to a vertical sump discharge pipe rising through the sump basin lid. The sump discharge pipe extends to and through a basement wall for exterior discharge above ground level. A float activator arm with a buoyant ball is positioned in the sump pit and arranged to automatically activate and deactivate the sump pump. An underground sanitary sewer line connected at one end to a sanitary sewer main is installed to run substantially vertically adjacent an interior basement wall and horizontally through the basement wall to an upward facing open end above ground level. The sanitary sewer line open end terminates opposite the discharge end of the sewage discharge pipe. An underground storm sewer line connected at one end to a storm sewer main is installed to run substantially vertically adjacent an interior basement wall and horizontally through the basement wall to an upward facing open end above ground level. The storm sewer line open end terminates opposite the discharge end of the storm discharge pipe.

DETAILED DESCRIPTION

The description, which follows, is provided by way of illustration of an example, or examples of particular embodiments of principles and aspects of the present invention. These examples are provided for the purposes of explanation, and not of limitation, of those principles and of the invention.

The integrated system of the invention is characterized by disconnection or removal of sewer piping [sanitary and storm] from inside the building to above ground termination ends outside the building. The sanitary sewer and storm sewer connections from the municipality to the building are disconnected before the building footing and re-routed vertically above ground adjacent an exterior wall of the building. Accordingly, there is no termination of the sanitary sewer and/or storm sewer lines from the municipality within the building above floor level or below the building.

Figure 1:
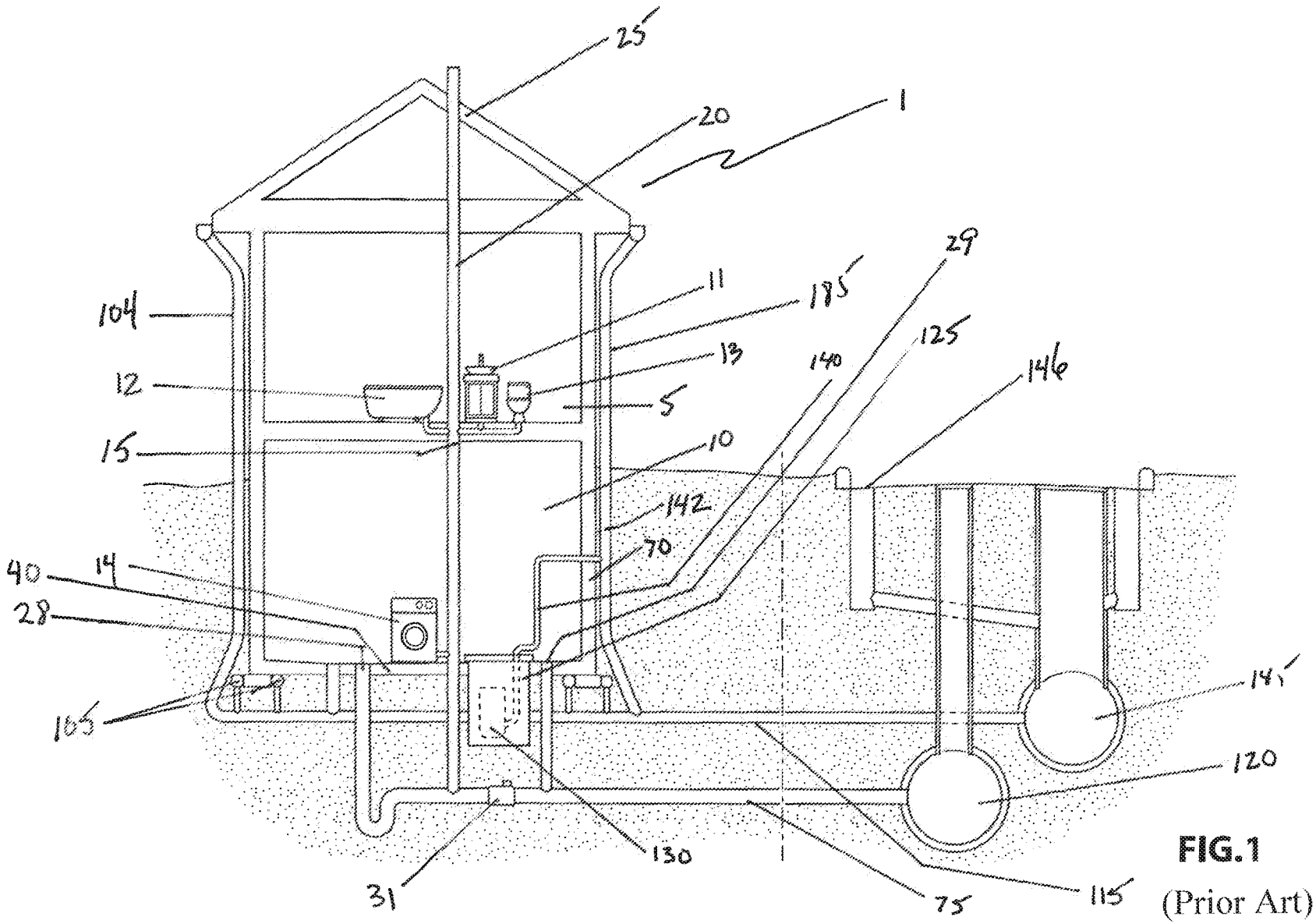
FIG. 1 (Prior Art)
FIG. 1 is a diagrammatic depiction of an arrangement of sanitary and storm sewer connections of a residential building with weeping tiles for the foundation, a sump pump pit and a backup/backflow valve.
Figure 2:
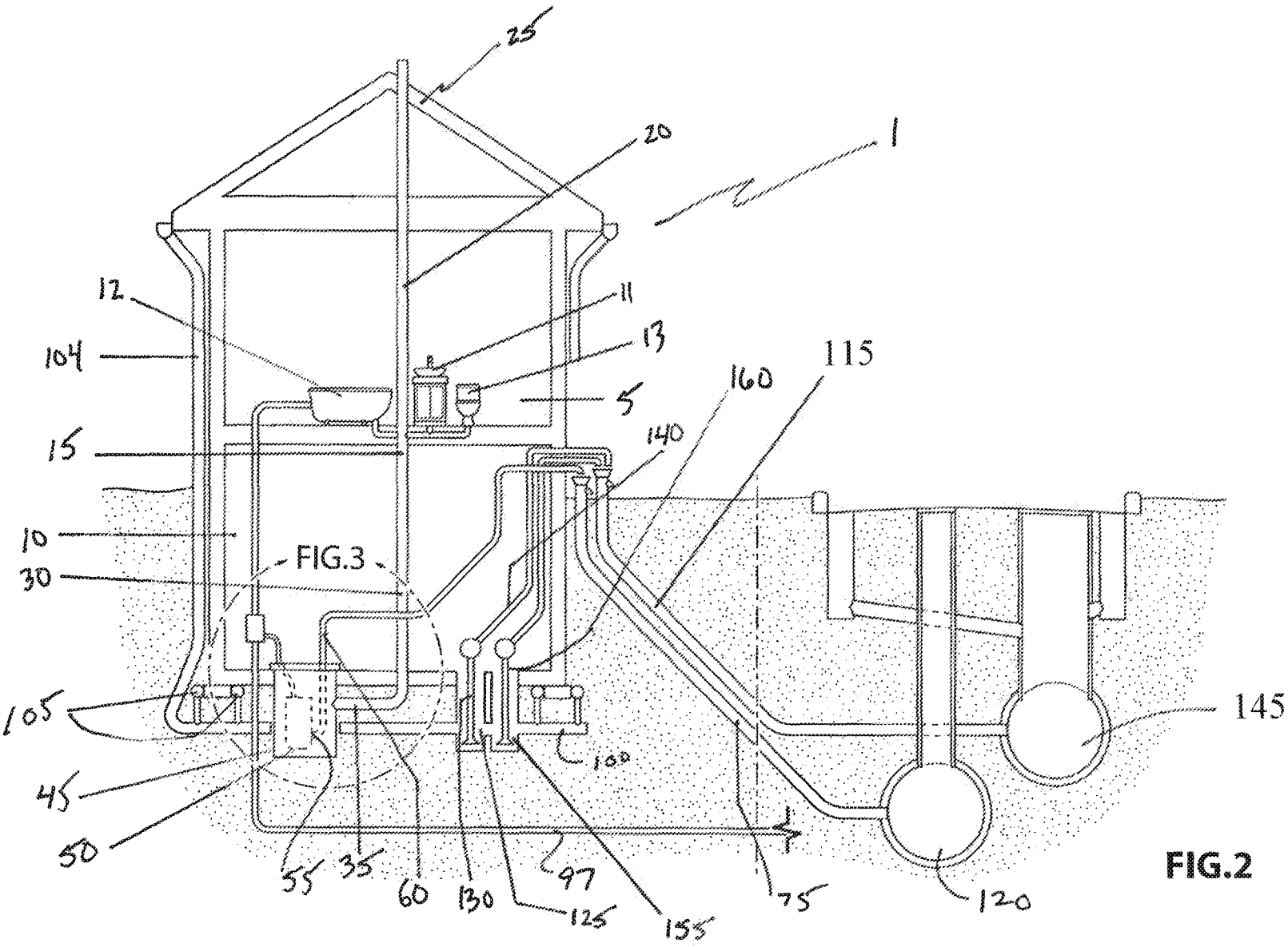
FIG. 2 is a diagrammatic depiction of an embodiment of the invention.
Figure 3:
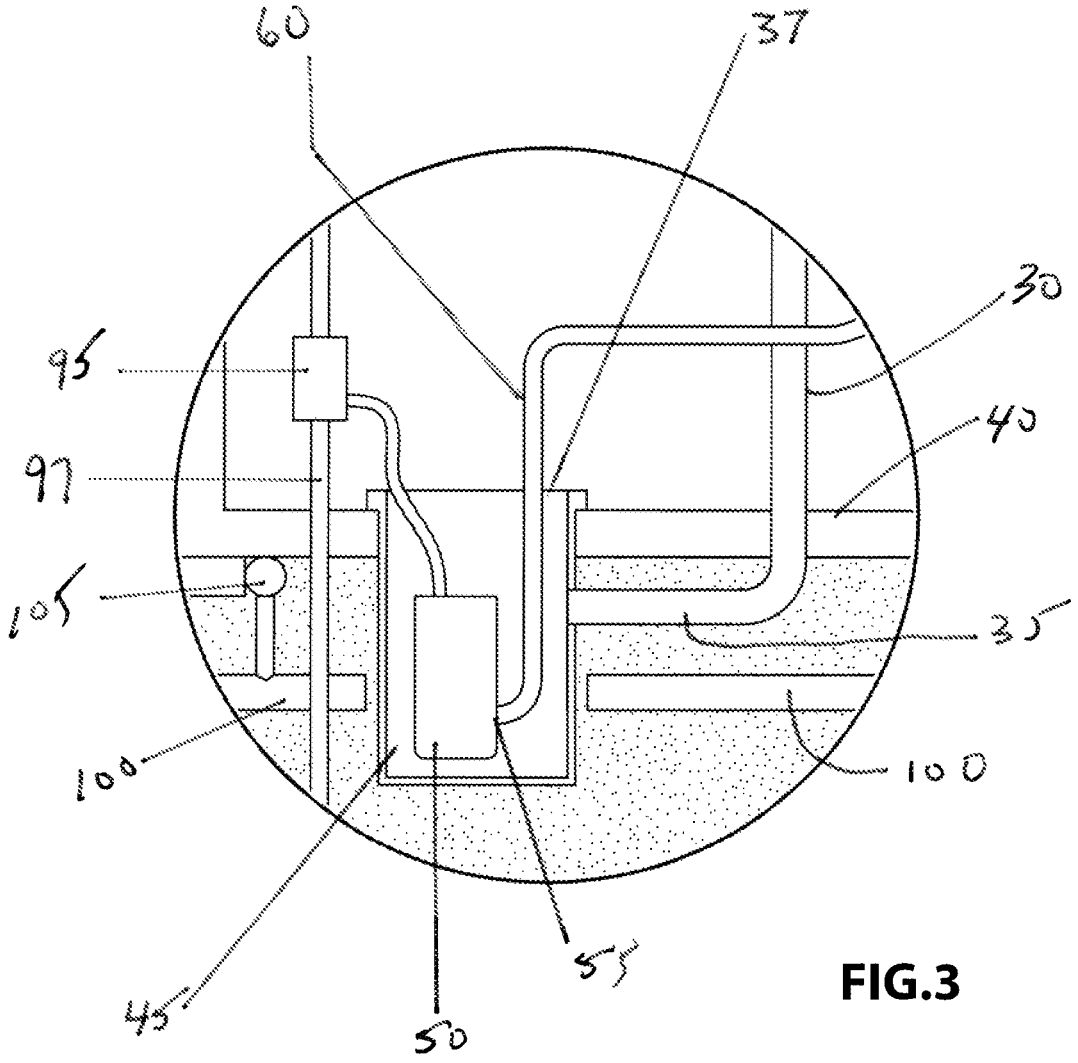
FIG. 3 is a detailed view of the sewage pit and pump of the sanitary collection system of FIG. 2.

Referring first to FIGS. 2, 3, 5 and 9, FIG. 2 depicts a residential building 1 having a main floor 5 and a basement 10. For simplicity, only one sink 11, bathtub 12 and toilet 13 is shown on the above ground floor level. More than one of each fixture may be present in a residential building either on the main level or in the basement as well as other fixtures such as one or more showers, a dishwasher and a washing machine. Each fixture has a drain pipe connected to a vertical 4 inch main drain pipe 15. The main drain pipe has an upper section 20 that vents to atmosphere through the roof 25 of the building and a lower section 30 in the basement. As shown in FIGS. 2 and 3, the lower drain pipe 30 connects to a horizontal 4 inch drain line 35 underneath the basement floor 40 and connects to a sewage basin or pit 45 installed below the basement floor. The drain line 35 is about 10.5 inches from the top lid 37 of the sewage basin. A submersible sewage pump 50 is installed at the lowest point of the sewage basin. Sewage pumps may be provided with an integrated vertical float [not depicted]. The sewage pump may optionally have legs attached to the pump housing, which keeps the pump a few inches above the bottom of the basin. Automatic sewage pumps have a floating switch, which turns the pump on and off whenever sewage in the basin reaches a certain (usually pre-set) level. Sewage pumps are centrifugal pumps, with special design considerations enabling solids to pass without clogging the pump. When the pump is turned on, the motor starts to rotate an impeller, creating the pressure that pushes water into the impeller and from there into the discharge pipe. The sewage pump is powered through an electrical line. Depending on the model, the voltage can be 120 or 240 volts.

Figures 4, 5:
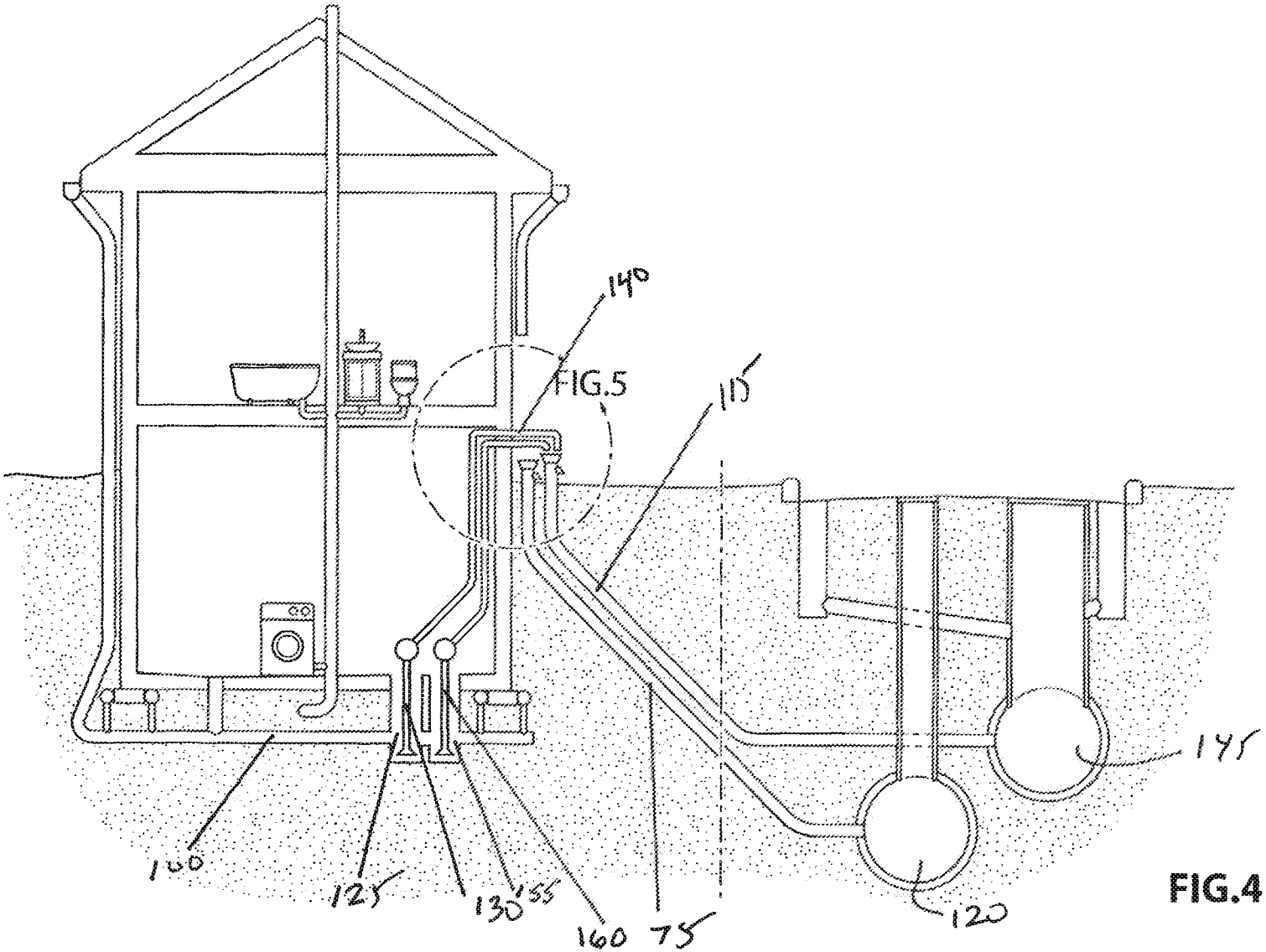
FIG. 4 is a diagrammatic depiction of the storm sewer and weeping tiles effluent collection aspect of the integrated system. For drawing clarity, the sanitary sewer collection aspect of the system is not shown in this drawing.
FIG. 5 is a detailed view of the sanitary sewer and storm sewer discharge lines through the building wall to termination ends above exterior sewage lines.
Figure 5:
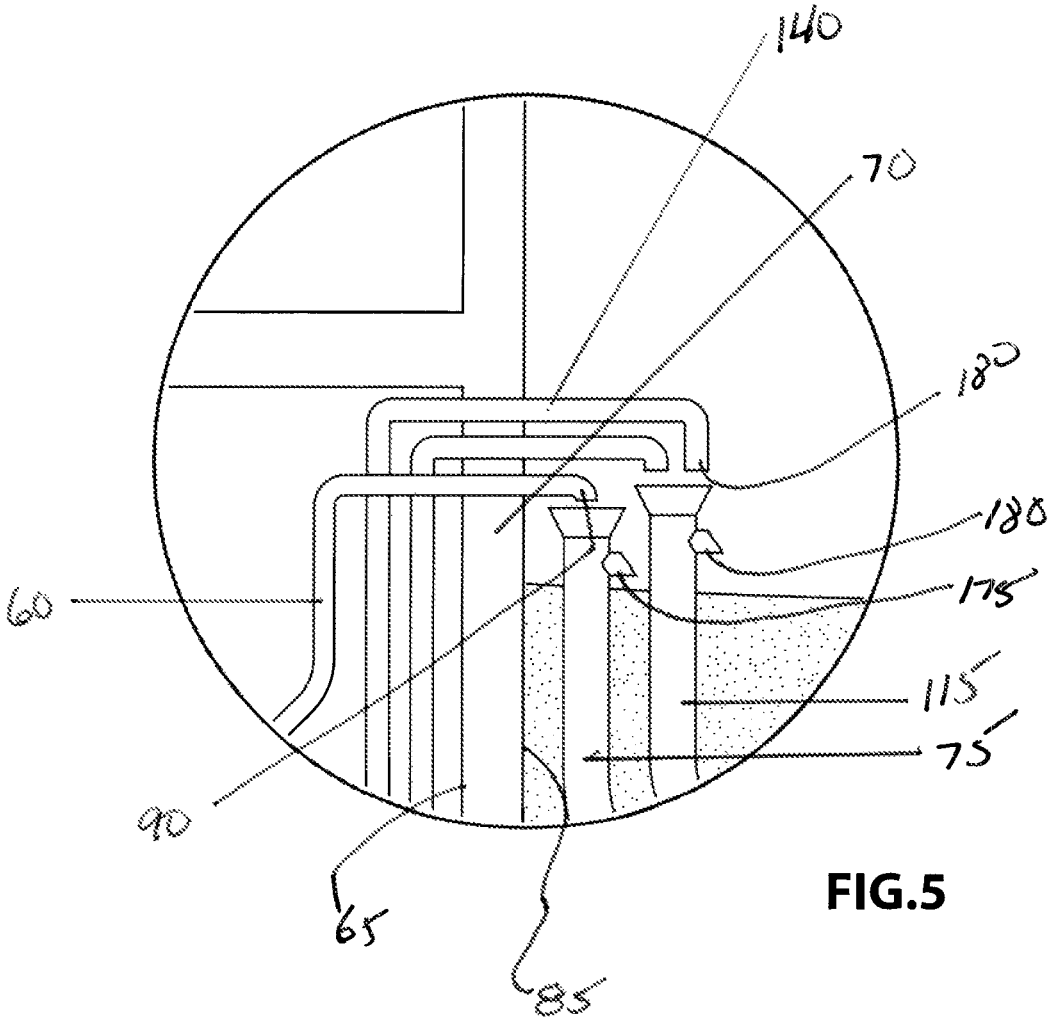
Figure 9:
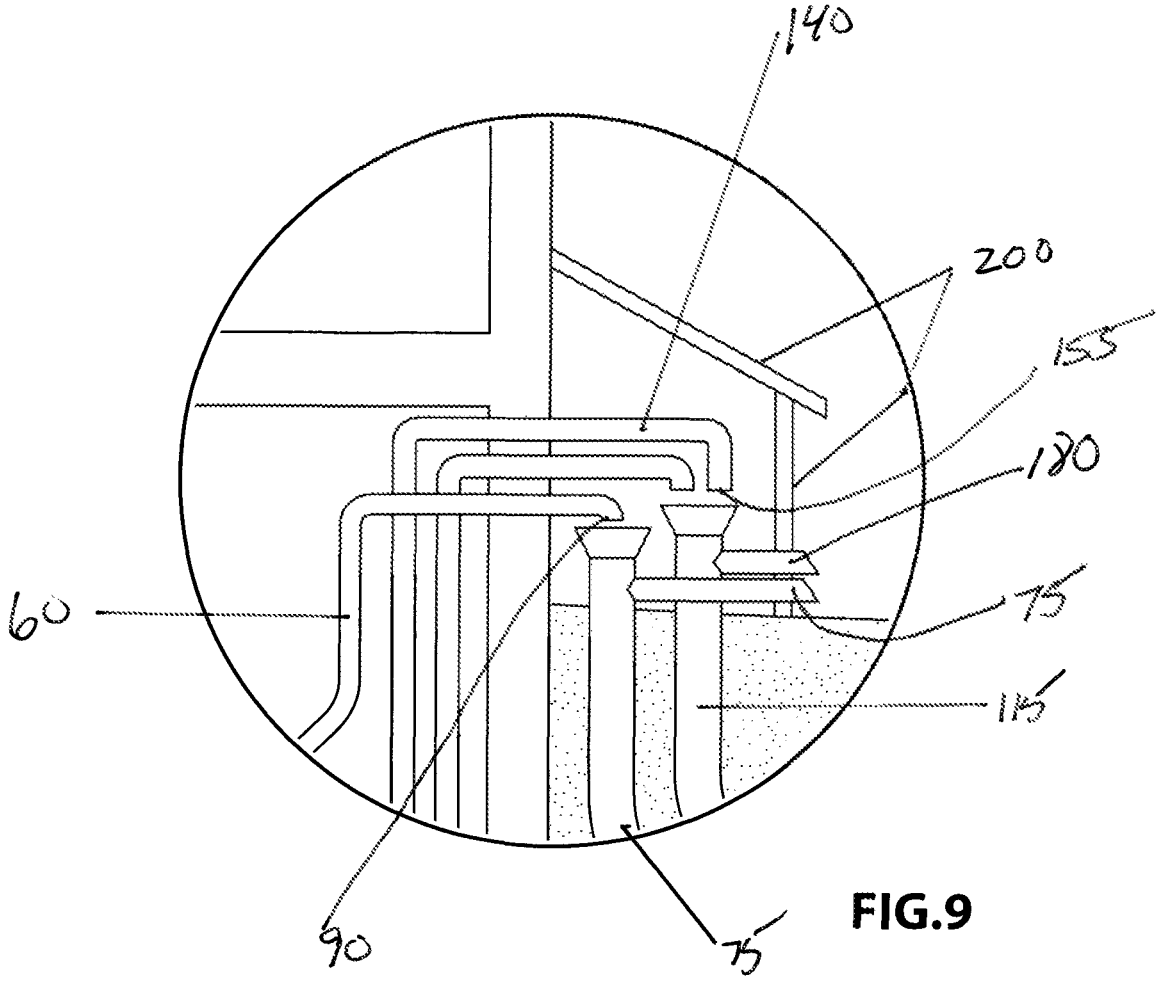
FIG. 9 is a detailed view of the discharge termination points of the integrated system within a surrounding enclosure.

Referring to FIGS. 2, 5, and 9 the sewage pump outlet 55 connects to a 2 inch vertically installed sewage discharge pipe 60 rising above the sewage basin lid 37. A check valve may optionally be installed in the sewage discharge pipe to prevent back flow into the sewage basin. A vent pipe [not shown] is connected to a vent hole in the basin lid and piped to a plumbing vent pipe. The sewage discharge pipe 60 is routed towards an interior basement wall 65 to a point above ground level where the pipe 60 exits through the basement wall 70 to the exterior side of the building 1. The sanitary sewer line 75 connecting to the sanitary sewer main 120 is re-routed adjacent the basement exterior wall 85 to terminate above ground level below the termination end 90 of the discharge sewage pipe 60. Sewage from the sewage discharge pipe discharges into the sanitary sewer line 75.

The sewage basin and sewage pump are sized according to the building size and sewage effluent flow.

As concerns FIGS. 2 and 3, although storm sewer line 100 is shown as ending at each side of sewage pit 45 for drawing clarity, sewer line 100 remains connected.

The described sewage collection system may optionally use an installed pre-plumbed sewage pump/basin system consisting of a submersible sewage pump, a corrosion-resistant sewage basin with a lid, a float and back flow valve. One example is an Everbilt™ ½ HP Submersible Pre-Plumbed 18 inch by 30 inch Sewage Basin System.

Referring to FIG. 3, a shutoff valve 95 is installed in the municipal water line 97 in the building and is provided with a signal receiver for receiving signals transmitted from the sewage pump 50. The shutoff valve is remotely closed if sewage pump 50 signals that the sewage pump basin 45 is not emptying. This prevents the sanitary system in the building from flooding into the building basement.

Storm sewer lines 100 and weeping tiles 105 from around the building footing are disconnected from the building storm sewer line 115 and connected to a pipe 120 discharging below the basement floor into a sump pit or basin 125 installed below the basement floor adjacent to an internal basement wall. The sump pit is of a sufficient size to collect water, based on the square footage of the building. Although a pedestal style sump pump 130 is depicted in FIG. 2, a submersible sump pump may optionally be used. A vent pipe [not shown] may be connected to a vent hole in the sump lid and piped to a plumbing vent pipe. The sump pump outlet side 135 connects to a 2 inch vertical discharge pipe 140 adjacent the basement interior wall. The discharge pipe 140 exits horizontally through the basement wall 70 and terminates above ground level. When the level in the sump pit reaches a pre-determined level, about 5 to 7 inches, a vertical float [not shown] activates the pump. The storm sewer line section 115 connecting to the storm sewer main 145 is disconnected from the building sewer line 100 and is re-routed adjacent the basement exterior wall 85 to terminate above ground level below the termination end 155 of the sump discharge pipe 60. The effluent from the sump discharge pipe 60 discharges into the storm sewer line 115 as shown in FIGS. 5 and 9.

The arrangement in FIG. 2 depicts a second sump pit 155 and a second pump 160 as a backup to the first to handle any overflow that the first pump cannot handle. The second sump pump utilizes the same discharge configuration as the first sump pit pump. There can be a number of these pits and pumps as necessary depending on the size of the area being drained.

The described sump collection system may optionally use an installed pre-plumbed sump pump/basin system consisting of a submersible sump pump, a corrosion-resistant sump basin with a lid, float and a back flow valve. One example is an Everbilt™ Pre-Plumbed 18 inch by 30 inch Sump Pump System.

FIG. 4 depicts alternate re-routed sanitary and storm sewer lines 75, 115 externally the building wall. For drawing clarity, the sump pit and sewage pit details are not shown.

Figure 6:
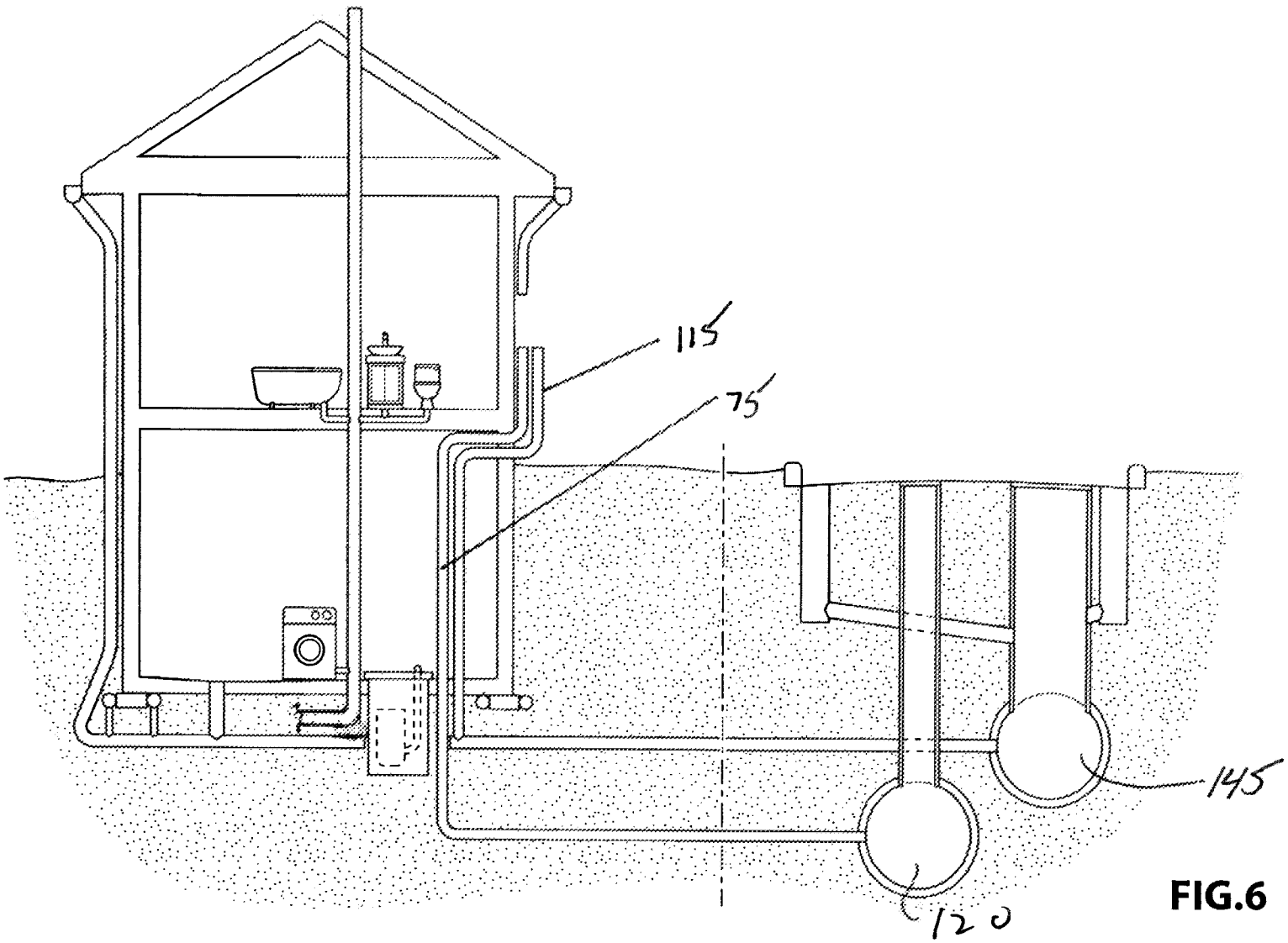
FIG. 6 is a diagrammatic depiction of a disconnection configuration wherein the sanitary sewer and storm sewer lines are rerouted vertically adjacent an interior wall of the basement and through the building exterior wall to termination ends above grade level. For drawing clarity, the sanitary sewer and storm sewer collection arrangements and discharge lines to the exterior rerouted lines are not shown.
Figure 7:
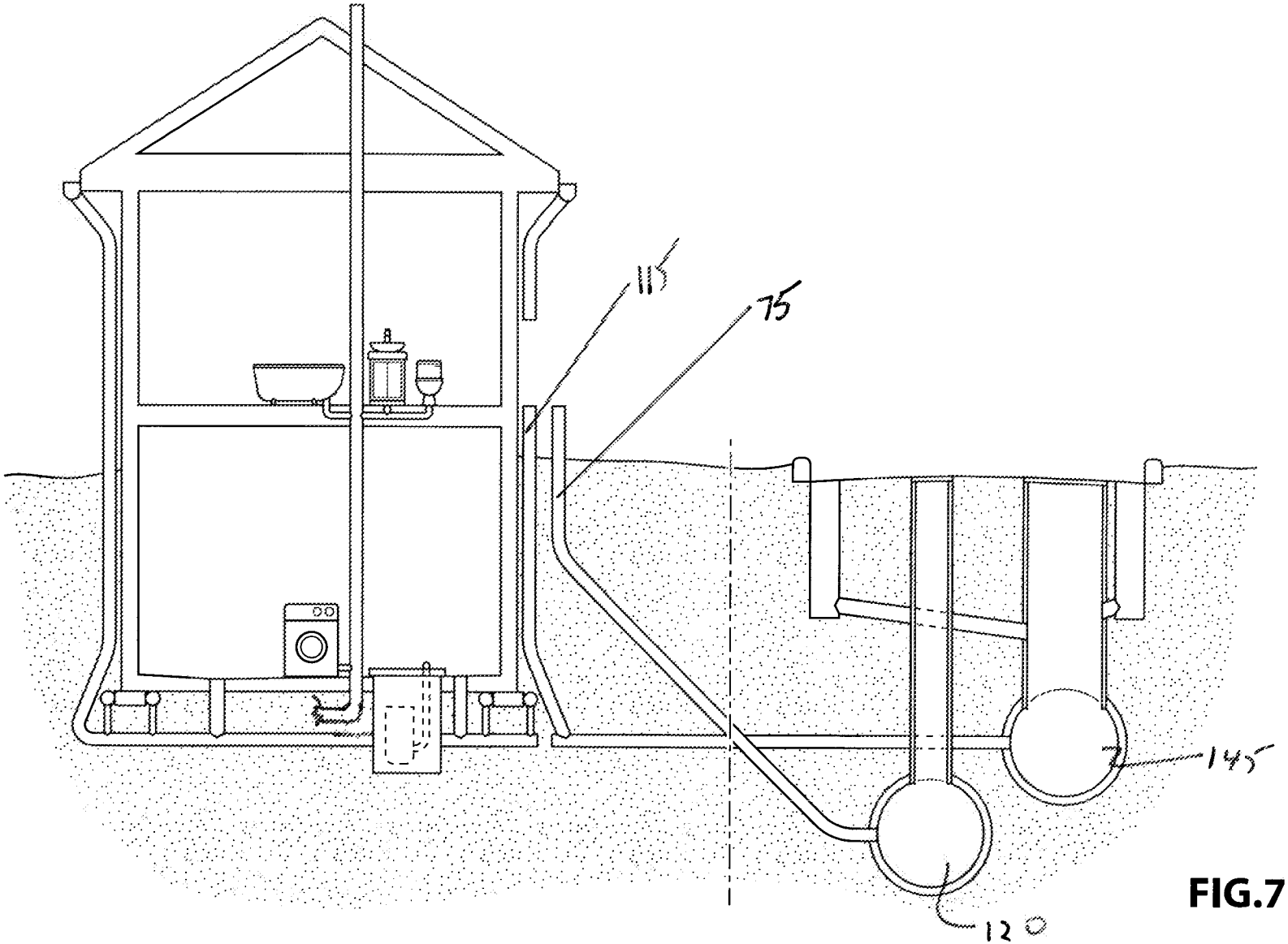
FIG. 7 is a diagrammatic depiction of a disconnection configuration wherein the sanitary sewer and storm sewer lines are rerouted adjacent the exterior basement wall of the building to termination ends above grade level. For drawing clarity, the sanitary sewer and storm sewer collection arrangements and discharge lines to the exterior rerouted lines are not shown.

FIG. 6 depicts another alternate re-routing of the sanitary and storm sewer line connections from the municipality. Again for drawing clarity, the sump pit and sewage pit details are not shown. The sewer lines 75, 115 are disconnected inside the basement of the house/building at the footing under the floor and installed vertically adjacent an inside basement wall to above ground level and exit horizontally through the basement wall to the outside of the building.

In the systems described herein, the sewer discharge pipes do not directly connect to the outside sewer lines within the building. Preferentially there will be at least air gap or air break separations between sewer discharge pipes 60, 140 and the outside sewer lines 75, 115 to avoid any possible backup and basement flooding from the municipal sewer lines into the building discharge pipes.

The re-routing of the sewer lines and termination above ground adjacent the building also reduces the risk of sanitary or storm sewer backup through those lines because the sewer lines are at least 8 to 10 feet above the level of the sanitary and storm mains. A very substantial sewage back flow would be needed to have sewage rise an 8 to 10 feet vertical height.

Bypass outlets 175, 180 may be installed in each of the outside sewer lines 75, 115 proximate their open ends so that if the outside sewer lines were to overflow, the overflow would be expelled onto the ground and not in the building.

Figure 8:
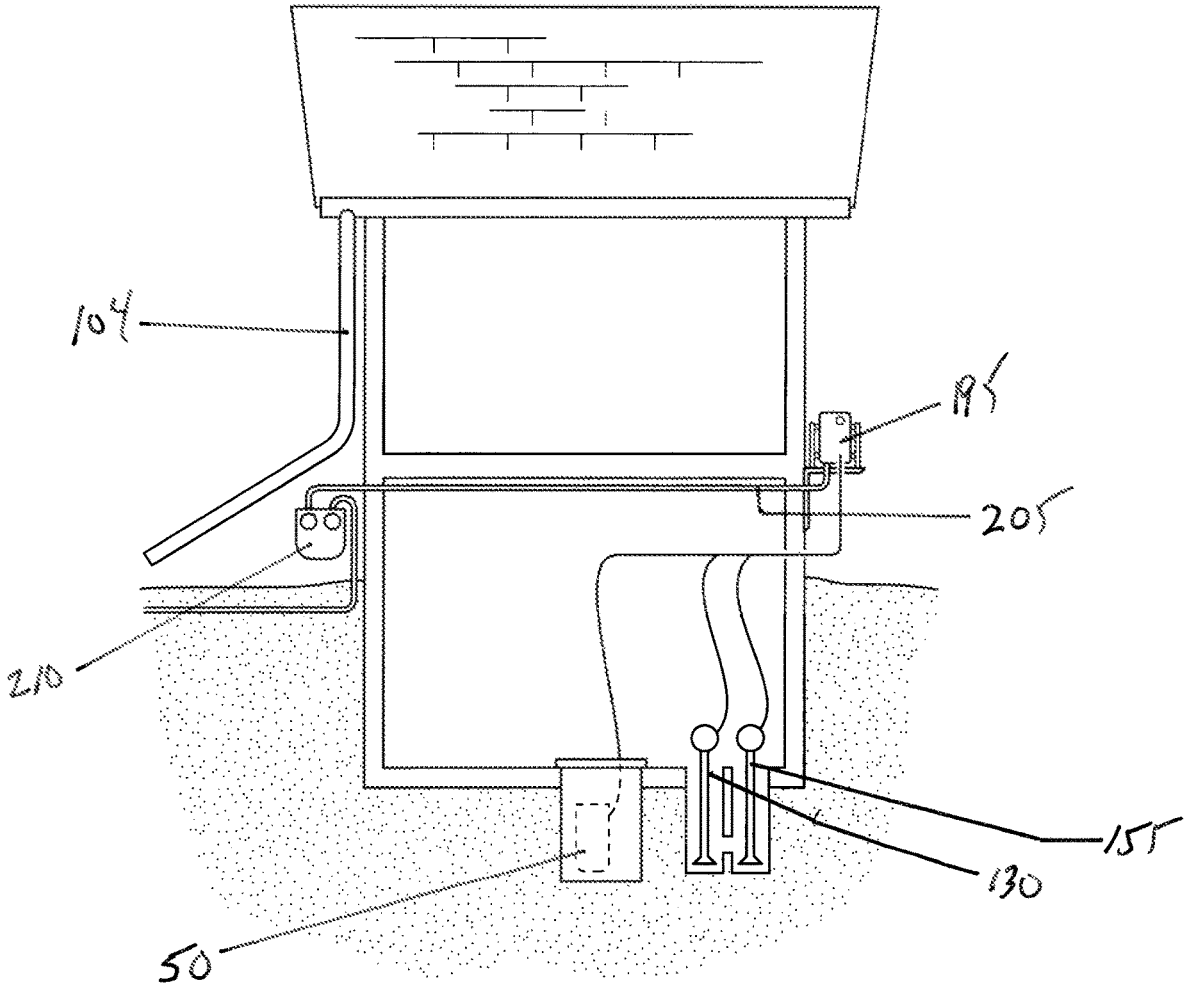
FIG. 8 is a diagrammatic depiction of an embodiment including a backup power/hydro system natural gas generator for operation of the system pumps.

As depicted in FIG. 8, the building downspouts 104, 185 for roof runoff water may be disconnected from the sewer system and rerouted to discharge onto the ground away from the building. The downspout connections into the ground are capped off and sealed.

As depicted in FIG. 9, a backup hydro or natural gas generator 195 may be installed to operate the sewage pump 50 and sump pump 130 in the event of a power outage. The generator may be operated by natural gas supplied by gas line 205 from gas meter 210. The generator is set to automatically start when a power outage occurs and automatically stops after power is restored.

FIG. 9 depicts an optional insulated enclosure 200 surrounding the above ground discharge pipes 60, 140 and sewer lines 75, 115 to prevent freezing of the sewage in the pipes/lines. The enclosure is preferably airtight to ensure no sewer gas escapes the enclosure into the atmosphere. The enclosure may be lockable.

While the principles of the invention have been shown and described in connection with specific embodiments, it is to be understood that such embodiments are by way of example and are not limiting As is evident from the foregoing description, certain aspects of the present invention are not limited by the particular details of the mobile stand illustrated in the drawings. Other modifications and applications, or equivalents, will occur to those skilled in the art. The terms "having", "comprising" and "including" and similar terms as used in the foregoing specification are used in the sense of "optional" or "may include" and not as "required". Many changes, modifications, variations and other uses and applications of the present construction will, however, become apparent to those skilled in the art after considering the specification and attached drawings. All such changes, modifications, variations and other uses and applications which do not depart from the spirit and scope of the invention are deemed to be covered by the invention which is limited only by the claims that follow. The scope of the disclosure is not intended to be limited to the embodiments shown herein, but is to be accorded the full scope consistent with the claims, wherein reference to an element in the singular is not intended to mean "one and only one" unless specifically so stated, but rather one or more.

The invention claimed is:

1. A basement flood control system for a building having an above ground level, a basement level and serviced by sewer lines connected to municipal sewer mains, the system comprising:

a building sanitary waste drain receiving effluent from fixture drains in the building, the sanitary waste drain connected to an inlet of a sewage basin installed into the basement floor at a first location, the sewage basin having side walls and a top lid;

a sewage pump installed in the sewage basin, the sewage pump having an outlet connected to a vertical sewage discharge pipe rising through the sewage basin lid and piped to and through a basement wall for exterior discharge above ground level;

a sewage float activator arm with a buoyant ball positioned in the sewage basin and arranged to automatically activate and deactivate the sewage pump;

a sump pit installed into the basement floor at a second location, the sump pit having side walls and a top wall;

a sump pump installed in the sump pit having an outlet connected to a vertical sump discharge pipe rising through the sump pit top wall and piped to and through a basement wall for exterior discharge above ground level;

a sump float activator arm with a buoyant ball positioned in the sump pit and arranged to automatically activate and deactivate the sump pump;

an underground sanitary sewer line connected at one end to a sanitary sewer main and installed to run substantially vertically adjacent an exterior basement wall to an open end above ground level, the sanitary sewer line open end terminating opposite the discharge end of the sewage discharge pipe; and an underground storm sewer line connected at one end to a storm sewer main and installed to run substantially vertically adjacent an exterior basement wall to an open end above ground level, the storm sewer line open end terminating opposite the discharge end of the sump discharge pipe.

2. The system of claim 1, further including a back flow valve in the vertical sewage discharge pipe and a back flow valve in the vertical sump discharge pipe.

3. The system of claim 1, wherein the sewage basin, sewage pump and sewage float activator arm with a buoyant ball are comprised of an installed kit, including a back flow valve.

4. The system of claim 1, wherein the sump pit, sump pump, and sump float activator arm with a buoyant ball are comprised of an installed kit, including a back flow valve.

5. The system of claim 1, wherein the inlet of the sewage basin is 10½ inches from the sewage basin lid.

6. The system of claim 1, wherein the sump pump is selected from a pedestal sump pump and a submersible sump pump.

7. The system of claim 1, wherein the sewage pump is activated when the sewage level in the sewage basin is one third to one half the height of the sewage basin.

8. The system of claim 1, wherein the sewage pump is deactivated when the sewage level is one third to one half the height of the sewage basin.

9. The system of claim 1, wherein the sump pump is activated when the water level in the sump pit is 5 to 7 inches.

10. The system of claim 1, wherein the sump pump is deactivated when the water level in the sump pit is below 5 inches.

11. The system of claim 1, further including a first bypass outlet before the sanitary sewer line open end and a second bypass outlet before the storm sewer line open end.

12. The system of claim 1, further including an exterior generator for generating power to the sewage pump and sump pump during an electrical power outage.

13. The system of claim 1, further including an insulated enclosure surrounding the exterior above ground discharge pipes and sewer lines.

14. A basement flood control system for a building having an above ground level, a basement level and serviced by sewer lines connected to municipal sewer mains, the system comprising:

a building sanitary waste drain receiving effluent from fixture drains in the building, the sanitary waste drain connected to an inlet of a sewage basin installed into the basement floor at a first location, the sewage basin having side walls and a top lid;

a sewage pump installed in the sewage basin, the sewage pump having an outlet connected to a vertical sewage discharge pipe rising through the sewage basin lid and piped to and through a basement wall for exterior discharge above ground level;

a float activator arm with a buoyant ball positioned in the sewage basin and arranged to automatically activate and deactivate the sewage pump;

a sump pit installed into the basement floor at a second location, the sump pit having side walls and a top lid;

a sump pump installed in the sump pit having an outlet connected to a vertical sump discharge pipe rising through the sump pit lid and piped to and through a basement wall for exterior discharge above ground level;

a float activator arm with a buoyant ball positioned in the sump pit and arranged to automatically activate and deactivate the sump pump;

an underground sanitary sewer line connected at one end to a sanitary sewer main and installed to run substantially vertically adjacent an interior basement wall and horizontally through the basement wall to an upward facing open end above ground level, the sanitary sewer line open end terminating opposite the discharge end of the sewage discharge pipe; and an underground storm sewer line connected at one end to a storm sewer main and installed to run substantially vertically adjacent an interior basement wall and horizontally through the basement wall to an upward facing open end above ground level, the storm sewer line open end terminating opposite the discharge end of the sump discharge pipe.

15. The system of claim 14, further including a back flow valve in the vertical sewage discharge pipe and a back flow valve in the vertical sump discharge pipe.

16. The system of claim 14, wherein the sewage basin, sewage pump, and sewage float activator arm with a buoyant ball are comprised of an installed kit, including a back flow valve.

17. The system of claim 14, wherein the sump pit, sump pump, and sump float activator arm with a buoyant ball are comprised of an installed kit, including a back flow valve.

18. The system of claim 14, wherein inlet of the sewage basin is 10½ inches from the sewage basin lid.

19. The system of claim 14, wherein the sump pump is selected from a pedestal sump pump and a submersible sump pump.

20. The system of claim 14, wherein the sewage pump is activated when the sewage level in the sewage basin is one third to one half the height of the sewage basin.

21. The system of claim 14, wherein the sewage pump is deactivated when the sewage level is one third to one half the height of the sewage basin.

22. The system of claim 14, wherein the sump pump is activated when the water level in the sump pit is 5 to 7 inches.

23. The system of claim 14, wherein the sump pump is deactivated when the water level in the sump pit is below 5 inches.

24. The system of claim 14, wherein the discharge end of the sewage discharge pipe and the open end of the sanitary sewer line and the discharge end of the storm discharge pipe and the open end of the storm sewer line are each separated by a gap of 6 inches.

25. A basement flood control system for a building having an above ground level, a basement level and serviced by sewer lines connected to municipal sewer mains, the system comprising:

a building sanitary waste drain receiving effluent from fixture drains in the building, the sanitary waste drain connected to an inlet of a sewage basin installed into the basement floor at a first location, the sewage basin having side walls and a top lid;

a sewage pump installed in the sewage basin, the sewage pump having an outlet connected to a vertical sewage discharge pipe rising through the sewage basin lid and piped to and through a basement wall for exterior discharge above ground level;

a sewage float activator arm with a buoyant ball positioned in the sewage basin and arranged to automatically activate and deactivate the sewage pump;

a sump pit installed into the basement floor at a second location, the sump pit having side walls and a top wall;

a sump pump installed in the sump pit having an outlet connected to a vertical sump discharge pipe rising through the sump pit top wall and piped to and through a basement wall for exterior discharge above ground level;

a sump float activator arm with a buoyant ball positioned in the sump pit and arranged to automatically activate and deactivate the sump pump;

an underground sanitary sewer line connected at one end to a sanitary sewer main and installed to run substantially vertically adjacent a basement wall to an open end above ground level, the sanitary sewer line open end terminating opposite the discharge end of the sewage discharge pipe; and an underground storm sewer line connected at one end to a storm sewer main and installed to run substantially vertically adjacent a basement wall to an open end above ground level, the storm sewer line open end terminating opposite the discharge end of the sump discharge pipe.

26. The system of claim 25 wherein the sanitary sewer line and the storm sewer line are installed to run substantially vertically adjacent the exterior of the basement wall.

27. The system of claim 25 wherein the sanitary sewer line and the storm sewer line are installed to run substantially vertically adjacent the interior of the basement wall.

* * * * *